United States Patent [19]

Pepin

[11] 4,184,344

[45] Jan. 22, 1980

[54] MOOD-INDICATING JEWELRY WITH CHANGEABLE DISPLAY

[76] Inventor: David E. J. Pepin, P.O. Box 354, Grant Park, Ill. 60904

[21] Appl. No.: 948,505

[22] Filed: Oct. 4, 1978

[51] Int. Cl.[2] ..... A44C 25/00

[52] U.S. Cl. ..... 63/31; 40/1.6; 40/502; 362/104

[58] Field of Search ..... 63/20, 31; 40/1.6, 502, 40/503, 506; 362/104

[56] References Cited

U.S. PATENT DOCUMENTS

| | | | |
|---|---|---|---|
| 907,497 | 12/1908 | Henderson | 40/502 X |
| 2,427,257 | 9/1947 | Campbell | 63/20 |
| 2,785,488 | 3/1957 | Brooks | 40/503 |
| 3,930,326 | 6/1974 | Rosa | 40/503 |
| 4,077,237 | 3/1978 | Loper | 63/31 |

*Primary Examiner*—F. Barry Shay

*Attorney, Agent, or Firm*—Leydig, Voit, Osann, Mayer & Holt, Ltd.

[57] ABSTRACT

A piece of jewelry for indicating mood and usable as a pendant or the like in the form of a miniature traffic light having three apertures of substantially the same size spaced in vertical alignment with one another and having a cylindrical inner surface. A carrier having a mating cylindrical surface is fitted inside of the housing. The carrier includes three vertically stacked sections colored red, amber and green which are relatively movable with respect to the housing and indexably arranged for selective individual viewing through the respective top, middle and bottom apertures. For moving the carrier it has an operator which extends through the housing for convenient fingertip manipulation to a color condition which depends upon the mood of the wearer. In the preferred embodiment of the invention the selected color is brought into register with the corresponding aperture by peripheral shifting, whereas in an alternate embodiment the desired color is brought into a condition of register by axial shifting. The alternate embodiment moreover has provision for simultaneous display of the same color on at least three sides of the device. Another embodiment may use transparent colored sections with a source of electric light, a battery and a switch.

7 Claims, 14 Drawing Figures

Fig. 7.
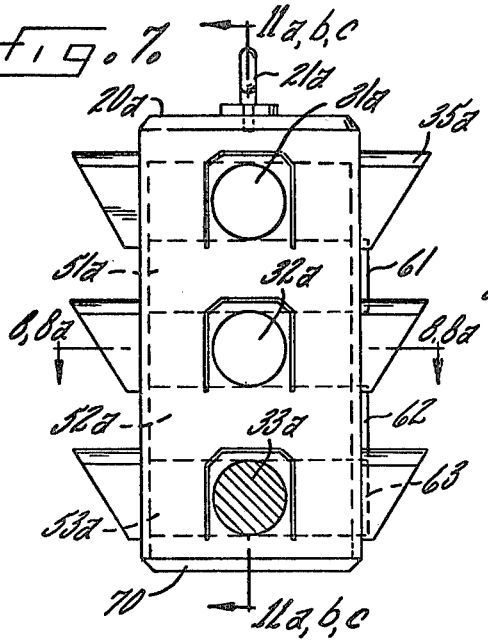
Fig. 8.
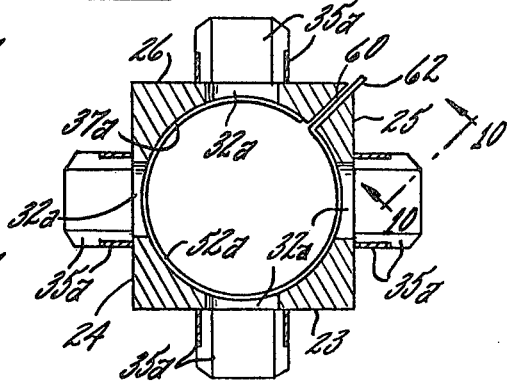
Fig. 8a.
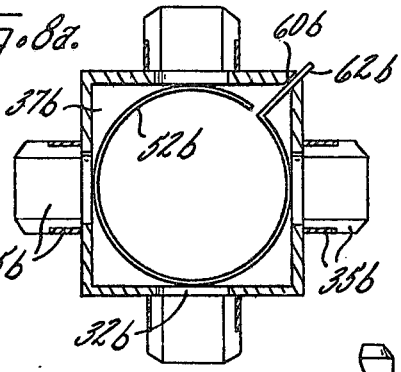
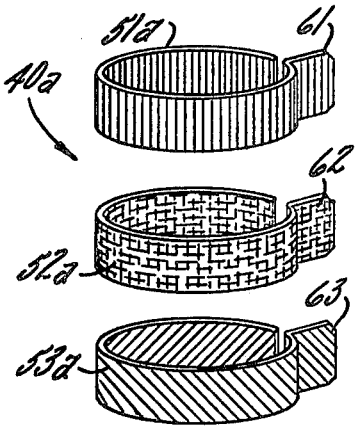
Fig. 9.
Fig. 10.
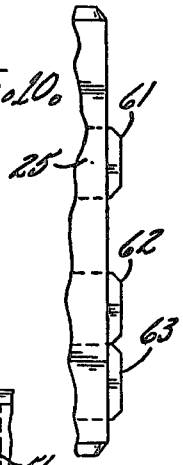
Fig. 11a.
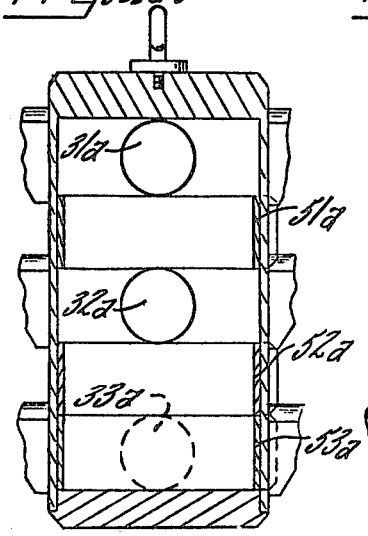
Fig. 11b.
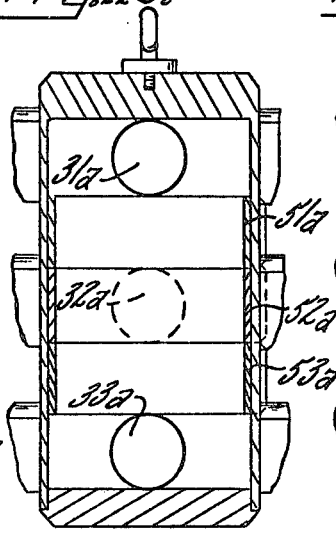
Fig. 11c.
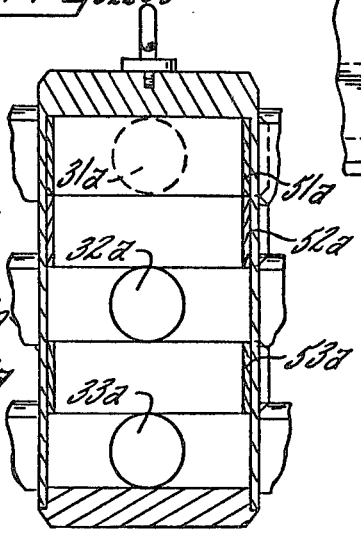

MOOD-INDICATING JEWELRY WITH CHANGEABLE DISPLAY

The Campbell U.S. Pat. No. 2,427,257 which issued Sept. 9, 1947 shows a brooch to be worn by a woman having as its centerpiece a representation of a traffic light with a movable index which is manually settable by the wearer to a selected color as an indicator of mood.

While the Campbell design has been known for the past thirty years or more, jewelry employing a traffic light motif has not been popular on the commercial market. It is believed that this is due to the fact that the traffic light as disclosed by Campbell is of a non-realistic rather rudimentary design. For example in the first embodiment all three of the lenses show color simultaneously and a shiftable arrow pivoted to a supporting mount is resorted to for color selection. In a second embodiment the selected color is displayed by the shifting of masks in front of the unwanted colors. The use of either arrows or masks is readily recognized as a makeshift and tends to destroy the traffic light illusion.

It is, accordingly, an object of the present invention to provide a piece of jewelry in the form of a traffic light which is more realistic in its appearance and in which a single selected color shows through the corresponding aperture without necessity for resorting to use of an external index or mask.

It is a related object to provide a piece of jewelry in the form of a traffic light which, while realistic, is of extremely simple construction consisting of an outer apertured housing having a carrier of cylindrical shape movably mounted therein, the carrier consisting of sections colored red, amber and green which are registrable with the corresponding aperture, the carrier having an operator which extends through the housing for convenient fingertip manipulation to achieve color selection.

It is a general object of the present invention to provide a piece of jewelry is realistic and which appears to have lenses which are selectively illuminated from the inside of the device but which is of simple inexpensive construction, constructed of a minimum number of pieces and avoiding the cost and complication of internal lighting.

It is an object, in one of the aspects of the invention, to provide a piece of jewelry having more than one set of lenses or apertures and in which the selected color shows up simultaneously in the corresponding lens of each set.

It is a general object of the invention to provide a piece of jewelry in the form of a stop light which is highly versatile and, unlike that of the prior art, can be employed as a simple pendant, charm or earring in a wide range of size down to the most miniature and formed of either plastic or precious metal, with the latter being particularly appropriate for the smaller sizes.

Other objects and advantages of the invention will become apparent upon reading the attached detailed description and upon reference to the drawings in which:

FIG. 7 is a face view of a modified form of the present invention.

FIG. 8 is a cross sectional view looking along line 8—8 in FIG. 7.

Figures 1, 2, 3, 4, 5, 6:
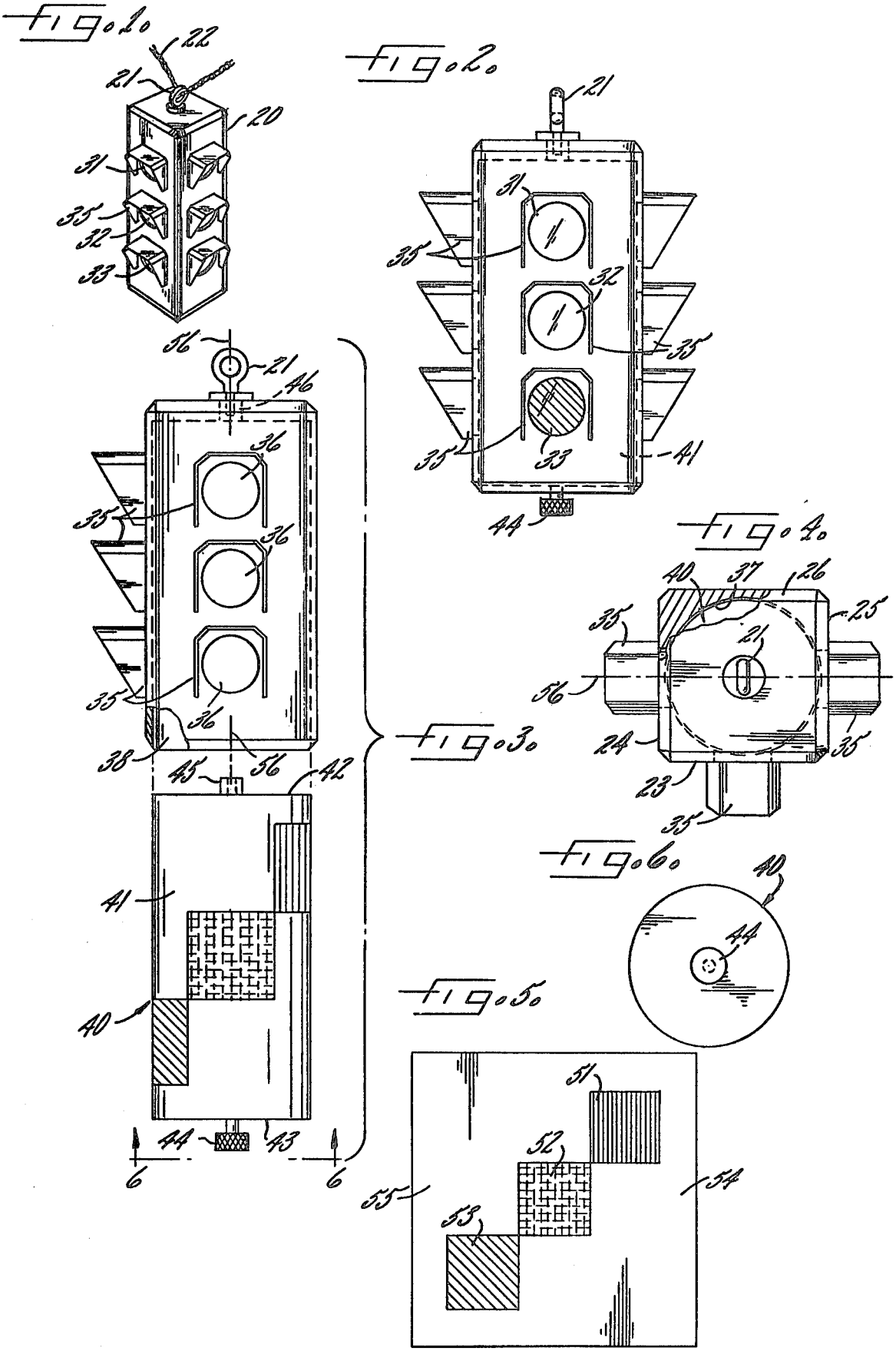
FIG. 1 is a perspective view of a piece of jewelry constructed in accordance with the invention and employed as a pendant, in approximately natural size.
FIG. 2 is an enlarged elevational, or face, view of the jewelry of FIG. 1.
FIG. 3 is an exploded side view corresponding to FIG. 2.
FIG. 4 is a top view of the device shown in FIG. 2.
FIG. 5 shows the surface of the rotor in developed form.
FIG. 6 is a bottom view of the rotor.

FIG. 8*a* is a view corresponding to FIG. 8 but showing a modified construction.

FIG. 9 is a view showing in perspective, the carrier construction used in FIGS. 7, 8 and 8*a* comprising three vertically stacked sections colored red, amber and green.

FIG. 10 is a fragmentary elevation taken along line 10—10 in FIG. 8 and showing the setting tabs.

FIG. 11*a* is a vertical section looking along line 11*a*—11*a* in FIG. 7 and showing the carrier sections set for the green condition.

FIGS. 11*b* and 11*c* are similar sections showing the carrier set for amber and red, respectively.

While the invention has been described in connection with certain preferred embodiments, it will be understood that there is no intention to be limited thereto and that I intend, on the contrary, to cover the various alternative and equivalent constructions included within the spirit and scope of the appended claims.

Turning to FIGS. 1–4, there is shown at 20 a piece of jewelry 20 in the form of a generally rectangular housing in the shape of a traffic light. While the piece of jewelry may be worn in a number of different ways, I have illustrated its use as a pendant having an eyelet 21 at the top through which is threaded a light chain or a necklace 22. The housing has a front wall 23, side walls 24, 25 and a back wall 26. Formed in the front wall 23 are a set of three vertically spaced apertures, which may be thought of as "lenses" 31, 32 33. Each aperture has a cowl or shade 35 to provide a touch of realism. On the sides 24, 25 of the device "dummy" lenses are used as indicated at 36, which dummy lenses may be painted black.

In accordance with the present invention the housing 20 has a cylindrical inner surface 37 defining an inner vertical chamber 38 (see FIG. 3) with which the apertures 31–33 communicate. Telescoped within the chamber is a carrier in the form of a rotor 40 having an outer cylindrical surface 41, an upper end 42 and a lower end 43. Secured to the lower end of the rotor is a knob 44 which projects below the lower end of the housing. At the top of the rotor is a threaded bushing 45 which projects through a clearance opening 46 at the upper end of the housing. For the purpose of holding the rotor 40 captive within the housing, while permitting it to rotate, the threaded bushing may be threadedly engaged by the lower end of the eyelet 21.

The rotor comprises three vertically stacked sections or areas 51, 52, 53 which are colored red, amber and green, respectively, and which, in the present embodiment, are peripherally offset from one another and horizontally aligned with the apertures 31, 32, 33 so that when the rotor is rotated, or indexed, the colored sections are individually viewable through the respective top, middle and bottom apertures of the housing. In short, by rotating the knob 44 the stop light can be caused to show red, amber or green in accordance with the mood of the wearer. The complimentary areas indicated at 54, 55 in FIG. 5 are preferably blackened for a "lights out" condition which contributes to the realism.

The type of red, amber (or yellow) and green pigment employed is a matter of choice, but it is preferred to use reflectorized, as well as pigmented, material for these surfaces in order to pick up a maximum amount of ambient light and to show up brightly as though illuminated from inside of the device. It is, however, one of the features of the device that it is entirely passive, not requiring electrical circuitry, batteries or lamps to achieve a condition of realism.

The device, as disclosed, may be manufactured very economically. The housing 20 may be formed in two parts by a plastic molding operation, with a parting line 56 (FIGS. 3 and 4). The carrier or rotor 40 may be made in one piece, with the knob 44 and bushing 45 either integral or in the form of metal attachments or inserts screwed, pressed or cemented in place. The pigmented areas 51, 52, 53 may be applied by an automated silk screening process in which the rotor is simply "rolled over" the silk screen. However, if desired, the colors may be applied to a printed adhesive label, appearing as shown in FIG. 5, which is pressure-adhesively applied to the surface of the rotor.

Assembly is simply a matter of inserting the rotor into the housing and screwing the eyelet into the housing to make it fast. Preferably the eyelet bottoms in the rotor, rather than bottoming on the top surface of the housing, and the fit between rotor and housing is such as to develop only the amount of friction which is sufficient to hold the rotor in its set position. Or other axial retaining means may be used.

The embodiment described above is equipped with only a single set of apertures, or "lenses", showing color. However, the invention is not limited thereto and if desired the colored sections of the carrier may be peripherally extended and made axially shiftable so as to enable more than a single one of apertures to be used and to show color. Indeed, where the device is of small dimension with no "natural" orientation the carrier may consist of axially slidable sections showing the selected color on all four sides of the device as set forth in the embodiment illustrated in FIGS. 7–11. In these figures similar reference numerals have been employed to indicate similar parts with addition of subscript a.

In carrying out the second embodiment of the invention a generally rectangular housing 20*a* is provided having an eyelet 21*a* at the top and having four sides 23–26. The housing has sets of apertures or lenses 31*a*, 32*a*, 33*a* having shades or cowls 35*a*, the apertures all surrounding and communicating with a central cylindrical chamber 38*a*. The carrier, collectively indicated at 40*a*, comprises three sections 51*a*, 52*a*, 53*a* (FIG. 9), colored red, amber (yellow) and green, respectively, in the form of outwardly sprung bands or rings made of light resilient material. These bands are snugly slidably received in the inner cylindrical chamber 38*a* so as to permit indexing for selective individual viewing through the respective apertures. For convenient fingertip manipulation of the sections to the desired color condition, the ring-shaped sections include integral radially extending tabs 61, 62, 63 which extend through a vertical slot 60 (see FIGS. 8 and 10) formed in one corner of the housing. The colored sections may be held captive within the central chamber by a bottom cap 70 (FIG. 11*a*) which may be cemented in position.

Typical adjustment to the "green" condition is illustrated in FIG. 11*a*. Here it will be noted that the lowermost ring 53*a* has been shifted downwardly into alignment with the lowermost aperture 33*a* to show the color green. The other two rings 51*a*, 52*a* are shifted to occupy positions out of alignment with the apertures 31*a*, 32*a* so the latter apertures show up "black", the interior of the housing being unlighted. The sections may be easily shifted by engaging the appropriate tabs with the edge of a finger nail or other sharp object.

The "yellow" condition is illustrated in FIG. 11*b*. Here the "amber" ring 52*a* is shown aligned with the central aperture 32*a*, so that the latter aperture displays amber coloration in all four of the sides of the device. The remaining sections, or rings, 51*a*, 53*a* are moved to their out-of-register positions so that the top and bottom apertures are "black", that is, without color.

Where it is desired to select the "red" condition, the upper ring 51*a* is moved into register with the upper aperture 31*a* and the other two rings are moved into non-aligned positions so that red becomes the distinctive color on all four sides of the device.

While the second embodiment is capable of providing color on all four sides, it will be apparent that the structure does not require this feature, and on any side not requiring the showing of color "dummy" apertures may be employed as in the embodiment earlier described.

In the two preferred forms of the invention discussed above a generally rectangular housing is employed having a cylindrical chamber, with the carrier being shiftable, either axially or peripherally within the chamber. However, it is not essential to the invention that the chamber 38, 38*a* be of cylindrical form and if desired the construction illustrated in FIG. 8*a* may be used in which the chamber, indicated at 38*b*, is of square section, nontheless accommodating, frictionally, a circular carrier section or ring 52*b*. The construction illustrated in FIG. 8*a* permits the housing to be folded from a thin sheet of gold or other precious metal which may be preferred as a material of construction where the device is made of miniature size suitable for use as a charm or earring.

Both of the embodiments discussed above are distinguished by a high degree of realism combined with a high degree of subtlety. The directive arrow and use of exernal sliding masks taught by Campbell are avoided thereby giving an attractive life-like appearance. Moreover, the Campbell construction is limited, as is practical, to use as a brooch while the present construction, not requiring any external appendages, may be used in many different ways as jewelry particularly in the free-hanging state as a pendant, earrings, charm and the like. Moreover, the present construction lends itself more readily to miniaturization than that of Campbell.

The term "respective apertures" used herein is intended to denote that one aperture is exclusively reserved for use of a display of given color, and while the colors have been employed in the same order as in an actual traffic light, the order of the colors may be inverted without departing from the invention. Also, while the term "knob" has been used to denote the means for rotatively positioning the rotor, it will be apparent that the term "knob" is a general term including any manual positioning means; for example, the eyelet may be employed to position the rotor or the lower end of the rotor may be simply roughened to a sufficient degree to apply the necessary torque. The term "circular" as used herein is employed to denote shape and does not require that the circle be continuous or complete.

The present device, while simple and unassuming, by a direct and outward indication of mood of the wearer is capable of saving endless hours of polite sparring and discussion, thereby contributing to energy conservation.

While the device has been described in connection with its use as jewelry, it will be understood that there is no intention, in use of that term, to limit the use to body wear and the device may, if desired, be sold or used with a small pedestal, or stand, for use on a night stand, dresser or the like.

Also while the device of FIGS. 1-6 is passive, depending upon reflection of light from the pigmented areas, the invention is not limited thereto and the pigmented areas may be translucent, with a source of illumination in the form of a simple lamp provided within the central chamber. Such a lamp may, for example, be energized by a battery of disc configuration located either at the upper or lower end of the rotor 40 and equipped with a suitable on-off switch.

What I claim is:

1. A piece of jewelry for indicating mood capable of being used as a pendant or the like which comprises, in combination, a generally rectangular housing in the shape of a traffic light, the housing having a cylindrical chamber therein, the housing having front, side, and back walls, the front wall having a set of three vertically spaced apertures of substantially the same size arranged in alignment with one another and in communication with the chamber, means in said chamber for displaying a color simulating a traffic signal through each aperture of said set of apertures, while simultaneously displaying a "lights out" condition through the other two apertures of said set, said means including a carrier in the form of a rotor having an outer cylindrical surface telescoped snugly inside of the cylindrical surface of the chamber, means for holding the rotor captive against endwise movement, the rotor having three vertically stacked sections colored red, amber and green peripherally offset from one another and horizontally aligned with the apertures so that when the rotor is rotated the colored sections are individually viewable through the respective top, middle and bottom apertures, the rotor having a knob at its lower end and extending downwardly from the housing for indexed movement of the rotor to a color condition selected in accordance with the mood of the wearer.

2. A piece of jewelry for indicating mood capable of being used as a pendant or the like which comprises, in combination, a hollow rectangular housing in the shape of a traffic light having at least one set of three vertically spaced apertures of substantially the same size arranged in alignment with one another and having an inner surface in communication with the apertures, means in said housing for displaying a color simulating a traffic signal through each aperture of said set of apertures, while simultaneously displaying a "lights out" condition through the other two apertures of said set, said means including a carrier having a cylindrical surface fitted snugly inside of the inner surface of the housing, the carrier comprising three vertically stacked sections colored red, amber, and green relatively shiftable with respect to the housing and indexibly arranged for selective individual viewing through the top, middle and bottom apertures, the carrier having operating means coupled thereto and extending through and beyond the housing for convenient fingertip manipulation of the carrier to a color condition selected in accordance with the mood of the wearer.

3. A piece of jewelry for indicating mood capable of being used as a pendant or the like which compromises, in combination, a generally rectangular housing in the shape of a traffic light, the housing having a cylindrical chamber therein defining four walls, at least one of the walls having a set of three vertically spaced apertures of substantially the same size arranged in alignment with one another and in communication with the chamber, means in said chamber for displaying a color simulating a traffic signal through each aperture of said set of apertures, while simultaneously displaying a "lights out" condition through the other two apertures of said set, said means including a carrier having a cylindrical surface and fitted snugly inside of the cylindrical surface of the chamber, the carrier comprising three vertically stacked sections colored red, amber, and green relatively shiftable with respect to the housing and indexibly arranged for selective individual viewing through the respective top, middle and bottom apertures, the carrier having operating means coupled thereto and extending through and beyond the housing for convenient fingertip manipulation of the carrier to a color condition selected in accordance with the mood of the wearer.

4. The combination as claimed in claim 2 in which the colored sections of the carrier are in the form of peripherally offset segments and in which the operating means is in the form of a knob for rotating the carrier about a central vertical axis.

5. The combination as claimed in claim 2 in which the color sections of the carrier are in the form of circular bands shiftable axially of the housing.

6. The combination as claimed in claim 5 in which the housing has at least three sets of apertures on its front and side surfaces respectively and in which the colored sections are of sufficient arcuate extent as to show the color simultaneously in corresponding positions in each of the sets of apertures.

7. A piece of jewelry for indicating mood capable of being used as a pendant or the like which comprises, in combination, a rectangular housing in the shape of a traffic light having a set of three vertically spaced apertures of substantially the same size arranged in alignment with one another and having an inner vertical chamber in communication with the apertures, means in said chamber for displaying a color simulating a traffic signal through each aperture of said set of apertures, while simultaneously displaying a "lights out" condition through the other two apertures of said set, said means including a vertically arranged carrier fitted snugly but slidably in the chamber adjacent the apertures, the carrier comprising three vertically stacked sections of red, amber, and green relatively shiftable with respect to the housing and arranged for indexed individual viewing through the top, middle and bottom apertures, the carrier having operating means coupled thereto and extending through, and beyond, the housing for convenient fingertip manipulation of the carrier sections to a selected condition which depends upon the mood of the wearer.

* * * * *